United States Patent [19]

Diehl et al.

[11] Patent Number: 4,857,446

[45] Date of Patent: Aug. 15, 1989

[54] FILTER DYE FOR PHOTOGRAPHIC ELEMENT

[75] Inventors: Donald R. Diehl; Ronda E. Factor, both of Rochester, N.Y.

[73] Assignee: Eastman Kodak Company, Rochester, N.Y.

[21] Appl. No.: 137,490

[22] Filed: Dec. 23, 1987

Related U.S. Application Data

[63] Continuation-in-part of Ser. No. 104,468, Oct. 5, 1987, abandoned, which is a continuation-in-part of Ser. No. 945,634, Dec. 23, 1986, abandoned.

[51] Int. Cl.[4] ..... G03C 1/84

[52] U.S. Cl. ..... 430/510; 430/507; 430/512; 430/517; 430/522; 430/553; 430/555

[58] Field of Search ..... 430/510, 517, 522, 512, 430/507, 553, 555

[56] References Cited

U.S. PATENT DOCUMENTS

| | | | |
|---|---|---|---|
| 3,560,214 | 2/1977 | Ruda | 96/84 |
| 4,092,168 | 5/1978 | Lemahieu et al. | 252/500 |
| 4,311,787 | 1/1982 | Lemahieu et al. | 430/522 |
| 4,420,555 | 12/1983 | Kreuger et al. | 430/507 |
| 4,587,195 | 5/1986 | Ishikawa et al. | 430/139 |

FOREIGN PATENT DOCUMENTS

| | | |
|---|---|---|
| 0109555 | 5/1974 | Fed. Rep. of Germany . |
| 135936 | 3/1960 | Japan . |
| 1395779 | 12/1972 | United Kingdom . |
| 2138961 | 4/1975 | United Kingdom . |
| 2032636 | 8/1979 | United Kingdom . |

OTHER PUBLICATIONS

Research Disclosure, Item 14416, Apr. 1976.

Hamer, The Cyanine Dyes and Related Compounds, pp. 463–485, 1964 (Reference Added by Examiner).

*Primary Examiner*—Jack P. Brammer

*Attorney, Agent, or Firm*—Paul L. Marshall

[57] ABSTRACT

Dyes having structure

A represents a substituted or unsubstituted nucleus having a carboxyphenyl or sulfonamidophenyl substituent selected from the group consisting of 2-pryazolin-5-ones free of any substituent bonded thereto through a carboxyl group, rhodanines, hydantoins, 2-thiohydantoins, 4-thiohydantoins, 2,4-oxazolidindiones, 2-thio-2,4-oxazolidindiones, isoxazolinones, barbiturics, 2-thiobarbiturics, and indandiones, R represent hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N and the carbon atoms to which they are attached, represent the atoms needed to complete a julolydyl ring, $R^3$ represents H, or substituted or unsubstituted alkyl or aryl, $R^5$ and $R^6$ each independently represents H, or $R^5$ taken together with $R^1$, or $R^6$ taken together with $R^2$, represent the atoms necessary to complete a carbocyclic ring such as tetrahydroquinoyl, and m is 0 or 1 are disclosed. The dyes are useful as filter dyes in photographic filter layers.

10 Claims, No Drawings

FILTER DYE FOR PHOTOGRAPHIC ELEMENT

This application is a continuation-in-part of U.S. patent application Ser. No. 104,468, filed Oct. 5, 1987 now abandoned, which is a continuation-in-part of U.S. patent application Ser. No. 945,634, filed Dec. 23, 1986 now abandoned.

FIELD OF THE INVENTION

This invention relates to filter dyes and their use in photographic elements.

BACKGROUND OF THE INVENTION

Filter dyes are widely used in photographic elements. Filter dyes may be located in several locations in an element. They may be in a radiation-sensitive layer, an overcoat layer, in a layer adjacent to the radiation-sensitive layer, in an interlayer of a multilayer element, in an undercoat layer adjacent to the support or in a backing layer on the side of the support opposite the radiation-sensitive layer.

When incorporated directly in the radiation-sensitive layer they can function to improve sharpness by absorbing light scattered from one silver halide grain to another. Such dyes are referred to as absorber dyes. Filter dyes also function to retard the sensitivity of one light sensitive layer relative to another in a multilayer element. By absorbing some of the exposing radiation the filter dye aids in balancing the sensitivities of all the light sensitive layers.

Filter dyes that function primarily to absorb unwanted radiation due to reflection or refraction from layer interfaces, the layer-support interface, and particularly from the back side of the support, are referred to as antihalation dyes. The layers that contain them are referred to as antihalation layers.

There are other places and purposes for filter dyes and filter layers. For example, a filter layer may be used in or near the overcoat layer to protect the light sensitive layer against radiation from certain spectral regions. In multilayer films where there may be two or more light sensitive layers, it is sometimes necessary to have filter dye interlayers. In duplitized® materials, such as X-ray films, filter layers are used to reduce crossover exposure of the light sensitive layers. Elimination of crossover exposure is an ideal that is highly desirable but has not yet been fully attained.

A number of problems are associated with filter dyes and filter layers. It is very important that the dyes remain in the layer and not wander or diffuse into the adjacent layers. This often necessitates the presence of a mordant to hold the dye in the layer. It is equally important for the dyes to be completely decolorized and/or removed from the element, usually during processing, after they have performed their function. Dye stability, especially under high temperature and high humidity incubation is also important.

In some photographic elements, it is desirable to absorb unwanted radiation across the entire visible spectrum. In such elements it is not unusual to use up to five filter dyes in a single filter layer to accomplish this objective. Clearly, it is desirable to reduce the number of filter dyes used in the layers of such elements.

U.S. Pat. No. 3,560,214 discloses dyes comprising a carboxyl and phenyl substituted pyrazoline nucleus linked through a methine group to a dialkylaminophenyl group. However these dyes, according to the patent and our own experiments, are migratory.

It is an objective of this invention to provide filter dyes for photographic elements which meet the foregoing requirements for filter dyes and do not cause post process dye stain or migrate from layer to layer.

SUMMARY OF THE INVENTION

The foregoing objectives are achieved with a dye having the formula:

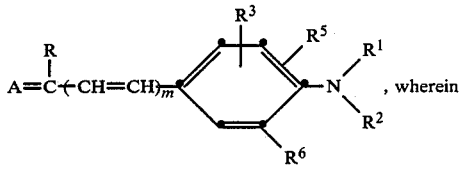

A represents a substituted or unsubstituted nucleus having a carboxyphenyl or sulfonamidophenyl substituent selected from the group consisting of 2-pyrazolin-5-ones free of any substituent bonded thereto through a carboxyl group, rhodanines, hydantoins, 2-thiohydantoins, 4-thiohydantoins, 2,4-oxazolidindiones, 2-thio-2,4-oxazolidindiones, isoxazolinones, barbiturics, 2-thiobarbiturics, and indandiones, R represents hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N, and the carbon atoms to which they are attached, represent the atoms needed to complete a julolydyl ring, $R^3$ represents H, or substituted or unsubstituted alkyl or aryl, $R^5$ and $R^6$ each independently represents H, or $R^5$ taken together with $R^1$, or $R^6$ taken together with $R^2$, represent the atoms necessary to complete a carbocyclic ring such as tetrahydroquinoyl, and m is 0 or 1.

In a preferred embodiment, the dyes of the invention are arylidenes having the formula:

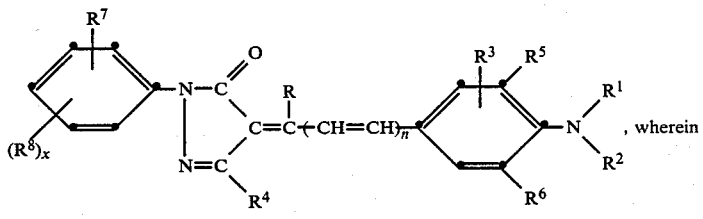

I

R represents hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N, and the carbon atoms to whatever they are attached, represent the atoms needed to complete a julolydyl ring, $R^3$ and $R^7$ each independently represents H, substituted or unsubstituted alkyl, aryl, alkoxy, hydrogen, or acetamido, $R^4$ represents substituted or unsubstituted alkyl, alkoxycarbonyl, aryl, acyl, or amido, $R^5$ and $R^6$ each independently represents H, or $R^5$ taken together with $R^1$, or $R^6$ taken together with $R^2$, represent the atoms necessary to complete a carbocyclic ring, $R^8$ is $CO_2H$ or $NHSO_2R^9$ wherein $R^9$ is substituted or unsubstituted alkyl or aryl, x is 1 or 2, and n is 0 or 1.

The carboxyphenyl or sulfonamidophenyl substituent on A in formula (I) and $R^8$ in formula (II) is important in immobilizing the dye at coating pH's of 5–7.

The acyl, alkyl and alkoxy groups may contain from one to twenty carbons. Examples of such groups include acetyl, benzoyl, methyl, ethyl, propyl, methoxy carboxyl, ethoxy carboxyl, butoxycarboxyl, fluoroalkyl, dodecyl, and octadecyl. The aryl groups may contain from six to twenty carbons, which may be further substituted with a wide variety of groups. Examples of such substituted and unsubstituted aryl groups including phenyl and napthyl with alkyl substituents as defined above.

Solid particle dispersions of the dyes of this invention leave no residual post-processing stain in processed photographic elements. Polymeric mordants are not needed to immobilize the dyes, as immobilization is achieved without mordants. Complete and irreversible dye removal during processing is achieved. Broadened and shifted absorption is obtained which makes the compositions particularly suitable for filter or antihalation applications. Their broadened absorption bands are particularly useful in reducing the number of dyes needed in a single element to absorb unwanted radiation. Another advantage is superior dye stability when subjected to high temperature and high humidity incubation.

DESCRIPTION OF THE PREFERRED EMBODIMENTS

Examples 1–3 below relate to the preparation of representative dyes of the invention. Variations on the procedures described to obtain other dyes of this invention, such as those of the examples and Table I and II below are within the skill of the practicing synthetic chemist. Procedures for making such dyes are described in "*The Cyanine Dyes and Related Compounds*", Frances Hamer, Interscience Publishers, 1964.

Abbreviations used in the examples are: NMR=nuclear magnetic resonance, IR=infrared, HCl=hydrochloric acid, EtOH=ethanol, MeOH=methanol, $Et_2O$=ethyl ether, DMF=dimethylformamide, DMSO=dimethylsulfoxide, NaOH=sodium hydroxide and mp=melting point.

EXAMPLE 1

Preparation of Dye 6, Table I

Step 1

Preparation of Intermediate-1-(3,5-Dicarboxyphenyl-3-methyl)-2-pyrazolin-5-one

A solution of sodium nitrite (35.8 g, 0.52 mol) in water (75 ml) was added to a slurry of 5-aminoisophthalic acid (90.6 g, 0.50 mol) in 4.8 molar HCl (500 ml) at 0° C. over 15 minutes with stirring. Stirring was continued for one hour at 0°–5° C. and the slurry was then added to a solution of sodium sulfite (270 g, 2.2 mol) in water (1.2 l) all at one time, with stirring, at 2° C. The resulting homogeneous solution was heated at 50°–60° C. for 45 minutes. Concentrated HCl (60 ml) was added and the reaction mixture was heated further at 90° C. for one hour. After cooling to room temperature, another portion of concentrated HCl (500 ml) was added. The solid was isolated by filtration and washed on a funnel with acidified water, EtOH and ligroin in succession. The off-white solid was dissolved in a solution of NaOH (76 g, 1.85 mol in 600 ml water). This solution was subsequently acidified with glacial acetic acid (166 ml, 3.0 mol) to yield a thick slurry. This was isolated by filtration, washed on the funnel with water, EtOH, and ligroin in succession, and thoroughly dried in a vacuum oven at 80° C., and 10 mm Hg. The mp was above 300° C. The NMR and IR spectra were consistent with the structure for 5-hydrazino-1,3-benzenedicarboxylic acid. The product gave a positive test for hydrazine with Tollens' reagent.

A slurry composed of the product 5-hydrazino-1,3-benzenedicarboxylic acid (64.7 g, 0.33 mol), ethylacetoacetate (50.7 g, 0.39 mol) and glacial acetic acid (250 ml) was stirred and refluxed for 22 hours. The mixture was cooled to room temperature and the product that had precipitated was isolated by filtration, washed with water, EtOH, $Et_2O$, and ligroin in succession and thoroughly dried in a vacuum oven at 80° C. and 10 mm Hg. The mp of the solid was above 310° C. The NMR and IR spectra were consistent with the assigned structure. The product gave a negative test with Tollens' reagent. The C, H, and N elemental analyses were in agreement with those calculated for the empirical formula.

Step 2

Preparation of 1-(3,5-Dicarboxyphenyl)-4-(4-dimethylaminobenzylidene)-3-methyl-2-pyrazolin-5-one (Dye 6, Table I)

A slurry composed of 1-(3,5-dicarboxyphenyl)-3-methyl-2-pyrazoline-5-one (44.6 grams, 0.17 mol), 4-dimethylamino-benzaldehyde (26.9 grams, 0.18 mol) and EtOH (500 mL) was heated at reflux for three hours. The reaction mixture was chilled in ice and the resulting crude orange product was isolated by filtration and washed with EtOH (200 mL). The product was purified by three repetitive slurries of the solid in acetone (1.4 l) at reflux and filtering to recover the dye. The mp of the product was above 310° C. The NMR and IR spectra were consistent with the structure assigned. The C, H, and N elemental analyses were in agreement with those calculated for the empirical formula.

EXAMPLE 2

Preparation of Dye 1, Table I (1-(4-Carboxyphenyl)-4-(4-dimethylaminobenzylidene)-3-methyl-2-pyrazolin-5-one A slurry composed of 1-(4-carboxyphenyl)-3-methyl-2-pyrazolin-5-one (21.8 g, 0.10 mol), 4-dimethylaminobenzaldehyde (14.9 g, 0.10 mol) and EtOH (250 ml) was heated at reflux for two hours. The reaction mixture was cooled to room temperature, resulting in a crude orange product which was isolated by filtration. The product was then washed with ether and dried. The product was purified further by making a slurry of the solid in EtOH (700 ml) at refluxing temperature and filtering the slurry to recover the dye. The treatment was repeated. The mp of the product was above 310° C. The NMR and IR spectra were consistent with the structure assigned. The C, H, and N elemental analyses were in agreement with those calculated for the empirical formula.

EXAMPLE 3

Preparation of Dye 11, Table I 1-(4-Carboxyphenyl)-4-(4-dimethylamino-cinnamylidene)-3-methyl-2-pyrazolin-5-one 1-(4-Carboxyphenyl)-3-methyl-2-pyrazolin-5-one (2.18 g, 0.010 mol), 4-dimethylamino-cinnamaldehyde (1.75 g, 0.010 mol) and glacial acetic acid (10 ml) were mixed together to form a slurry. It was heated to reflux with stirring, held at reflux for five minutes and then cooled to room temperature. EtOH (20 ml) was added to the reaction mixture, which was heated again to reflux, held there for five minutes, and cooled to room temperature. The product was isolated by filtration, washed in succession with ethanol and ligroin, and dried. The reaction was repeated twice on the same scale and the products obtained were all combined. They were treated further by first slurrying in refluxing EtOH (150 ml), isolating the solid by filtration while hot, and then slurrying in refluxing MeOH (200 ml) and isolating it again, while hot, by filtration. The mp was 282°–284° C. The NMR and IR spectra were consistent for the structure assigned. The C, H, and N elemental analyses were in agreement with those calculated for the empirical formula of the dye.

The dyes prepared in Examples 1–3 and other dyes of the invention prepared with similar properties are listed in Tables I and II along with their absorption maxima (in methanol solution with a stabilizing amount of triethylamine) and extinction coefficients.

TABLE I

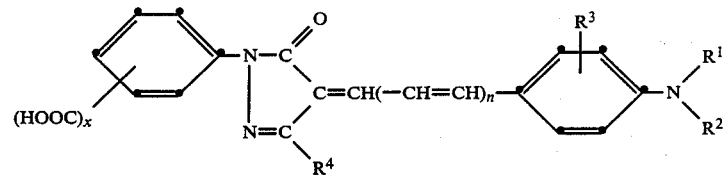

| Dye | $R^1$, $R^2$ | $R^3$ | $R^4$ | 1-Ph Substn. x Position | | n | λ-max (nm) | ε-max ($10^{-4}$) |
|---|---|---|---|---|---|---|---|---|
| 1 | $CH_3$ | H | $CH_3$ | 1 | 4 | 0 | 466 | 3.73 |
| 2 | $C_2H_5$ | H | $CH_3$ | 1 | 4 | 0 | 471 | 4.75 |
| 3 | n-$C_4H_9$ | H | $CH_3$ | 1 | 4 | 0 | 475 | 4.50 |
| 4 | $CH_3$ | H | $COOC_2H_5$ | 1 | 4 | 0 | 508 | 5.20 |
| 5 | i-$C_3H_7OCCH_2$ ‖ O | $CH_3$ | $CH_3$ | 1 | 4 | 0 | 430 | 3.43 |
| 6 | $CH_3$ | H | $CH_3$ | 2 | 3,5 | 0 | 457 | 3.78 |
| 7 | $C_2H_5$ | H | $CH_3$ | 2 | 3,5 | 0 | 475 | 4.55 |
| 8 | n-$C_4H_9$ | H | $CH_3$ | 2 | 3,5 | 0 | 477 | 4.92 |
| 9 | i-$C_3H_7OCCH_2$ ‖ O | H | $CH_3$ | 2 | 3,5 | 0 | 420 | 3.62 |
| 10 | i-$C_3H_7OCCH_2$ ‖ O | $CH_3$ | $CH_3$ | 2 | 3,5 | 0 | 434 | 3.25 |
| 11 | $CH_3$ | H | $CH_3$ | 1 | 4 | 1 | 516 | 4.62 |
| 12 | O ‖ i-$C_3H_7OC$ $CH_2$ | H | $CH_3$ | 1 | 4 | 0 | 420 | 3.94 |
| 13 | $CH_3$ | H | O ‖ C $CH_3$ | 1 | 4 | 0 | 573 | 5.56 |
| 14 | $CH_3$ | H | COOEt | 1 | 4 | 1 | 576 | 5.76 |
| 15 | $CH_3$ | H | $CH_3$ | 2 | 3,5 | 1 | 506 | 3.90 |
| 16 | $CH_3$ | H | COOEt | 1 | 4 | 0 | 502 | 4.83 |
| 17 | $CH_3$ | H | COOEt | 2 | 3,5 | 1 | 560 | 5.25 |
| 18 | $C_2H_5$ | H | COOEt | 1 | 4 | 0 | 512 | 6.22 |
| 19 | $CH_3$ | H | $CF_3$ | 1 | 4 | 0 | 507 | 4.58 |
| 20 | $CH_3$ | H | Ph | 1 | 4 | 0 | 477 | 4.54 |

TABLE I-continued

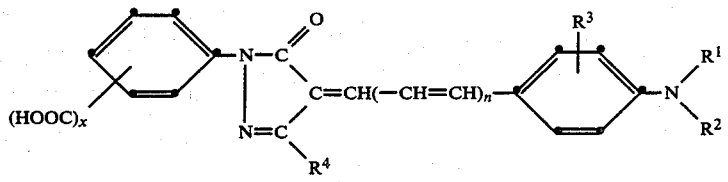

| Dye | $R^1$, $R^2$ | $R^3$ | $R^4$ | 1-Ph Substn. x Position | | n | λ-max (nm) | ε-max ($10^{-4}$) |
|---|---|---|---|---|---|---|---|---|
| 21 | $CH_3$ | H | O ‖ C $CH_3$ | 1 | 4 | 0 | 506 | 5.36 |

TABLE II

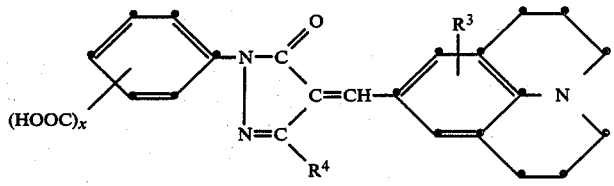

| Dye | $R^3$ | $R^4$ | 1-Ph Substn x Position | | λ-max (nm) | ε-max ($10^{-4}$) |
|---|---|---|---|---|---|---|
| 22 | H | $CH_3$ | 1 | 4 | 500 | 5.82 |
| 23 | H | $CH_3$ | 2 | 3,5 | 502 | 5.47 |

The above dyes in Tables I and II may also have sulfonamido substituents instead of the carboxyl substituents, such as:

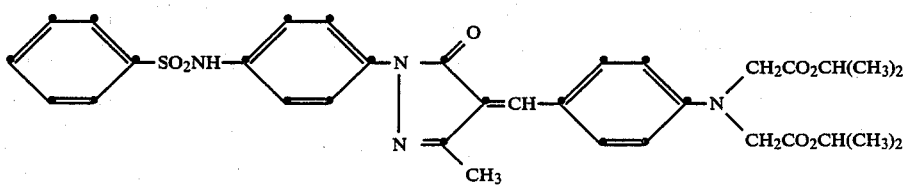

or

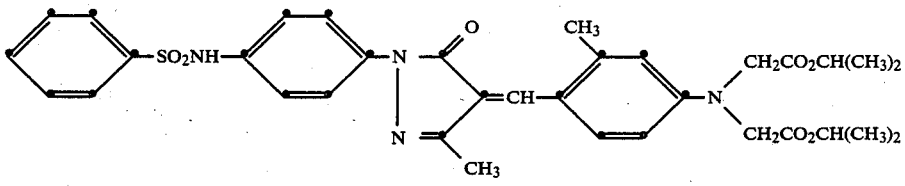

The dyes of this invention are useful in, for example, black and white, single color, multicolor, or duplitized ® X-ray photographic elements. They can be present in any layer of the element where it is desirable to include a filter dye, for example, in the silver halide emulsion layer or a separate filter layer. The dyes of the invention can be utilized in any amount that is useful to filter or absorb light, but it is particularly advantageous to utilize them in an amount and in a location so that they will be solubilized and washed out during processing. In situations where it is desirable to absorb only a small amount of light, only a small amount of dye is needed. In situations where it is desirable to absorb a larger amount of light, larger amounts of dye can be used, as long as the stain level remains at a level that is acceptable for that particular photographic element. Useful amounts of dye range from 1 to 1000 mg/ft$^2$. The dye should be present in an amount sufficient to yield an optical density at the transmission D-max in the visible region before processing of at least 0.10 density units and preferably at least 0.50 density units. This optical density will generally be less than 5.0 density units for most photographic applications.

The dyes of the invention are preferably in the form of a solid particle dispersion for incorporation into a layer such as a hydrophilic colloid layer coated on a photographic element, although some of the dyes can also be incorporated in other ways, such as in the solvent phase of an "oil in water type" dispersion or in loaded polymer latex particles, such as those described in Research Disclosure, Item 19551, July, 1980. The solid particle dispersion can be formed by precipitating the dye in the form of a dispersion and/or by well-known milling techniques, e.g., ball-milling, sand-milling, or colloid-milling the dye in the presence of a dispersing agent. The dye particles in the dispersion preferably have a mean diameter of less than about 10 μm and more preferably of less than about 1 μm. The dye particles can be conveniently prepared in sizes ranging down to about 0.01 μm or less.

In the following discussion of suitable materials for use in the emulsions and elements of this invention, reference will be made to *Research Disclosure,* December 1978, Item 17643, published by Kenneth Mason Publications, Ltd., The Old Harbourmaster's, 8 North Street, Emsworth, Hampshire P010 7DD, ENGLAND, the disclosures of which are incorporated herein by reference. This publication will be identified hereafter by the term "*Research Disclosure*".

The radiation-sensitive layer of the element of the invention can contain any of the known radiation-sensitive materials, such as silver halide, diazo image-forming systems, light-sensitive tellurium-containing compounds, light-sensitive cobalt-containing compounds, and others described in, for example, J. Kosar, Light-Sensitive Systems: Chemistry and Application of Non-silver Halide Photographic Processes, J. Wiley & Sons, N.Y. (1965). Radiation-sensitive materials exhibiting sensitivity to blue light and especially those sensitive to blue light and at least some other wavelength of radiation are preferred, as the dyes according to the invention can be advantageously used to absorb some or all of the blue light.

Silver halide is especially preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure,* Section I. Also useful are tabular grain silver halide emulsions, as described in *Research Disclosure,* January, 1983, Item 22534 and U.S. Pat. No. 4,425,426.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure,* Sections I–IV.

Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806, issued Dec. 7, 1982.

A typical multicolor photograhic element would comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element can contain additional layers, other filter layers, interlayers, overcoat layers, subbing layers, and the like.

In addition to the couplers the elements can include additional couplers as described in *Research Disclosure* Section VII, paragraphs D, E, F and G and the publications cited therein. These couplers can be incorporated in the elements and emulsions as described in *Research Disclosure* Section VII, paragraph C and the publications cited therein.

The photographic elements of individual layers thereof, can contain brighteners (see Research Disclosure Section V), antifoggants and stabilizers (see *Research Disclosure* Section VI), antistain agents and image dye stabilizer (see *Reseaarch Disclosure* Section VII, paragraphs I and J), light absorbing and scattering materials (see *Research Disclosure* Section VIII), hardeners (see *Research Disclosure* Section XI), plasticizers and lubricants (see *Research Disclosure* Section XII), antistatic agents (see *Research Disclosure* Section XIII), mating agents (see *Research Disclosure* Section XVI) and development modifiers (see *Research Disclosure* Section XXI).

The photographic elements can be coated on a variety of supports as described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

The dye of formula (I) can be located in any layer of a photographic element where it is desired to absorb light. In a preferred embodiment, the dye is preferably located in a layer where it will be subjected to high pH (i.e., 8 to 12) and aqueous sulfite during photographic processing, so as to allow the dye to be solubilized and removed or decolorized.

The photographic elements of the invention, when exposed, can be processed to yield an image. During processing, the dye of formula (I) will generally be decolorized and/or removed. Following processing, the dye of the invention should contribute less than 0.10 density unit, and preferably less than 0.02 density unit to the transmission D-max in the visible region in the minimum density areas of the exposed and processed element.

Processing can be by any type of known photographic processing, as described in *Research Disclosure,* Sections XIX–XXIV, although it preferably includes a high pH (i.e., 8 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The following examples illustrate the use of the dyes of the invention in filter layers of photographic elements.

EXAMPLES 4–23

Procedure for Preparation of the Solid Particle Dye Dispersions

The dyes were subjected to ball-milling according to the following procedure. Water (21.7 ml) and a 6.7% solution of Triton X-200 ® surfactant (TX-200 ®) (2.65 g) (available from Rohm & Haas) were placed in a 60 ml screw-capped bottle. A 1.00 g sample of dye was added to this solution. Zirconium oxide (ZrO) beads (40 ml) (2 mm diameter) were added and the container with the cap tightly secured was placed in a mill and the contents were milled for four days. The container was removed and the contents added to a 12.5% aqueous gelatin (8.0 g). The new mixture was placed on a roller mill for 10 minutes to reduce foaming and the resulting mixture was then filtered to remove the ZrO beads.

Coating Procedure

A spreading agent, surfactant 10G ®, and a hardener (bis(vinyl-sulfonylmethyl)ether) were added to the dye-gelatin melt prepared as described in the preparation of the solid particle dye dispersions. A melt prepared from the latter mixture was then coated on polyethylene terephthalate support to achieve a dye coverage of 0.32 $g/m^2$, gelatin coverage of 1.60 $g/m^2$, a spreading agent level of 0.096 $g/m^2$ and a hardener level of 0.016 $g/m^2$. Spectral data were obtained from an analysis of the coatings on a spectrophotometer interfaced with a computer. A summary of the data obtained is in Table III where the dye numbers correspond to those of Tables I and II. All absorption maxima and half band width (HBW) data are expressed in nanometers (nm). Three sets of absorption data are presented: λ-max and HBW of the coating containing the ball-milled dispersion of the dye, λ-max and HBW of the same coating at pH 10, the pH at which the chromophore is fully ionized, and λ-max and HBW of the dye in methanol solution.

In addition to the data in Table III, absorption spectra of the coatings for dyes 1, 2, 3, 6, 10 and 11 were made. Comparison of the curves of coatings containing a solid particle dispersion of a particular dye with the same dye in a coating at pH 10 showed the solid particle dispersion absorbance maximum was shifted compared to the solution spectra. This provides an unexpected advantage for use as a filter dye.

Referring to Table III, it is clear that the absorption spectra of the coatings containing the solid particle dye dispersion are broader than for the same dyes in solution or in coatings at pH 10. Thus, solid particle dispersions of the dyes of the invention are suitable for filter applications where broad visible light filtration is required. This broad absorption also serves to reduce the number of dyes needed for a particular filter application.

TABLE III

| Table I | Solid Particle Coating | | Coating (pH 10) | | Solution | |
|---|---|---|---|---|---|---|
| Dye | λ-max | HBW | λ-max | HBW | λ-max | HBW |
| 1 | 444 | 145 | 441 | 135 | 466 | 90 |
| 2 | 493 | 173 | 453 | 112 | 471 | 84 |
| 3 | 507 | 133 | 459 | 122 | 475 | 70 |
| 4 | 499 | 195 | 489 | 100 | 508 | 67 |
| 5 | 461 | 150 | 421 | 110 | 430 | 91 |
| 6 | 551 | 125 | 437 | 110 | 457 | 91 |
| 7 | 494 | 130 | 467 | 101 | 475 | 75 |
| 8 | 488 | 127 | 467 | 104 | 477 | 78 |
| 9 | 470 | 183 | 423 | 89 | 420 | 86 |
| 10 | 486 | 137 | 427 | 99 | 434 | 98 |
| 11 | 480 | 210 | 462 | 139 | 516 | 130 |
| 12 | 428 | 151 | — | — | 420 | 86 |
| 13 | 488 | 211 | — | — | 573 | 116 |
| 16 | 501 | 192 | — | — | 502 | 71 |
| 18 | 506 | 98 | — | — | 512 | 64 |
| 19 | 491 | 176 | — | — | 507 | 64 |
| 20 | 493 | 161 | — | — | 477 | 90 |
| 21 | 437 | 91 | — | — | 506 | 64 |
| 22 | 477 | 124 | 482 | 108 | 500 | 70 |
| 23 | 505 | 129 | 492 | 89 | 502 | 66 |

EXAMPLES 24–29

Dye Immobilization in Coating and Removal During Processing

The coated solid particle dye dispersions prepared as described in the previous examples were evaulated for dye mobility. Samples of the coatings were given a five minute distilled water wash. The results for four of the dyes, 1, 2, 3 and 5, are shown in Table IV. The coatings were also evaluated for post processing stain following processing in the Kodak Prostar ® processor used commercially to process microflim, subjecting the elements to a development step at a pH of 11.4 for 30 seconds. These results are also included in Table IV.

TABLE IV

| | | Optical Density | |
|---|---|---|---|
| Dye | Before | After $H_2O$ Wash | After Prostar |
| 1 | 2.255 | 2.292 | 0.007 |
| 2 | 1.782 | 1.795 | 0.010 |
| 3 | 1.440 | 1.451 | 0.007 |
| 5 | 1.403 | 1.383 | 0.013 |
| 24* | 1.43 | 0.01 | 0.01 |

*Dye 24 is a comparison dye of the structure:

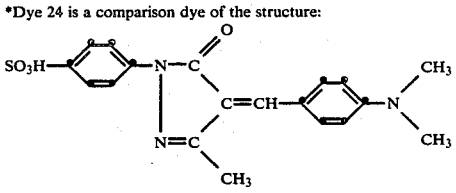

which exhibited a λ-max of 450 nm and a bandwidth of 117 nm before any washing or processing.

Table IV shows that no dye density was lost by the dyes dispersed and coated as described in the previous examples due to the distilled water wash. This shows that there was no dye wandering from layer to layer. The comparison dye, on the other hand, exhibited severe washout, indicating a high degree of dye wandering.

Table IV also demonstrates dramatically the complete removal of the solid particle dispersion dyes on Prostar ® processing at room temperature. No residual stain is left. The same results were observed when the coatings were processed with Kodak X-Omat ® processing, which is used commercially to process x-ray film, subjecting the elements to a development step at a pH of 10.3 for 30 seconds. This is an improvement over other known latex imbibed yellow filter dyes which are incompletely removed by these processing conditions.

For Examples 28 and 29, solid particle dispersions of dyes of the formula:

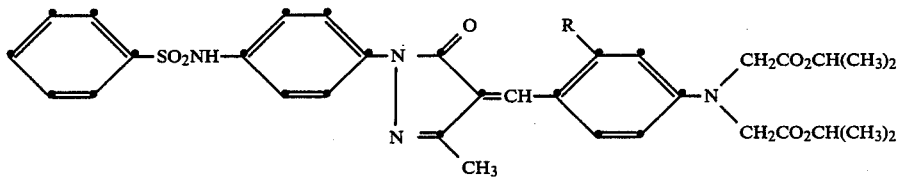

were coated as with Examples 24–27, and subjected to a 5-minute distilled water wash and processed with Kodak E-6 ® processing, as described in *British Journal of Photography Annual,* 1977, pp. 194–97. The results are presented in Table V.

TABLE V

| Dye | R | Optical Density Before | After $H_2O$ Wash | After E-6 ® |
|---|---|---|---|---|
| 25 | H | 1.04 | 1.26 | 0.01 |
| 26 | $CH_3$ | 1.72 | 1.66 | 0.01 |
| 24 | — | 1.43 | 0.01 | 0.01 |

Dye 25 had a λ-max of 449 nm and a bandwidth of 121 nm before washing or processing. Dye 26 had a λ-max of 453 nm and a bandwidth of 97 nm before washing or processing. The results in Table V indicate that the photographic compositions of the invention containing Dyes 25 and 26 do not wander during the water wash, but decolorize completely after photograhic processing. The comparison Dye 24, however, washes out during the water wash, indicating severe wandering.

EXAMPLE 30

Evaluation of Dyes of the Invention in Antihalation Layers in Combination With Other Dyes The utility of solid particle dyes of this invention, in combination of other dyes, is illustrated with dyes 1 and 5 of Table I. The dispersions were prepared as in examples 5–19. These dispersions were each coated as a component of an antihalation layer in a multilayer format, along with a cyan filter dye, bis[1-(4-carboxyphenyl)-3-methyl-2-pyrazolin-5-one -(4)]pentamethineoxonol. The coatings, 1 to 4 in Table VI, were evaluated for dye stain after processing. The emulsion layer was a chemically and spectrally sensitized 0.25 micron cubic silver bromoiodide (3% iodide) emulsion layer coated to achieve silver coverage of 1.45 g/m$^2$ and gelatin coverage of 1.56 g/m$^2$. The gelatin coverage in the antihalation layer was 1.88 g/m$^2$. The levels of dyes 1 and 5 and of the cyan dye are indicated in Table VI. The gelatin coverage in the overcoat layer was 1.56 g/m$^2$. The coatings were exposed to a tungsten light source in a sensitometer, developed, fixed and washed in the Kodak Prostar ® process and dried.

TABLE VI

| Coating No. | Dye | Level g/m$^2$ | Cyan Level |
|---|---|---|---|
| 1 | 1 | 0.11 | 0.11 |
| 2 | 1 | 0.16 | 0.16 |
| 3 | 5 | 0.11 | 0.11 |
| 4 | 5 | 0.16 | 0.16 |

The coatings containing solid particle dispersions of dyes 1 and 5 and the cyan filter dye, at the levels shown in Table I, exhibited no residual dye stain and provided significantly high light absorption.

We claim:

1. A photographic element comprising a support and a radiation-sensitive silver halide emulsion layer and a filter layer comprising a hydrophilic binder and an amount effective as a photographic filter dye of a solid particle dispersion of a compound having the formula:

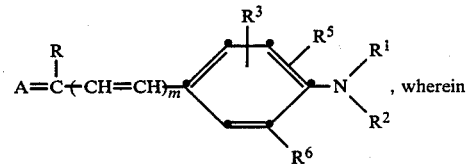

, wherein

A represents a substituted or unsubstituted acidic 2-pyrazolin-5-one nucleus free of any carboxyl substituent bonded thereto, said nucleus having a carboxyphenol or sulfonamidophenyl substituent, R represents hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N, and the carbon atoms to which they are attached, represent the atoms needed to complete a julolydyl ring, $R^3$ represents H, or substituted or unsubstituted alkyl or aryl, $R^5$ and $R^6$ each independently represents H, or $R^5$ taken together with $R^1$, or $R^6$ taken together with $R^2$, represent the atoms necessary to complete a carbocyclic ring, and m is 0 or 1, the particles of said dispersion having a mean diameter of from about 0.01 to 10 μm.

2. A photographic element according to claim 1 wherein the dye layer is located on the opposite side of the support from the radiation-sensitive layer.

3. A photographic element according to claim 1 wherein the radiation-sensitive silver halide emulsion layer is on one side of the support, and further comprising a second radiation-sensitive silver halide emulsion on the other side of the support, and wherein the dye layer is located between one of the radiation-sensitive layers and the support.

4. A photographic element comprising a support and a radiation-sensitive silver halide emulsion layer comprising a hydrophilic binder and an amount effective as a photographic filter dye of a solid particle dispersion of a compound having the formula:

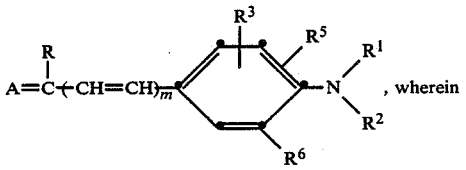

, wherein

A represents a substituted or unsubstituted acidic 2-pryazolin-5-one nucleus free of any carboxyl substituent bonded thereto, said nucleus having a carboxyphenyl or sulfonamidophenyl substituent, R represents hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N, and the carbon atoms to which they are attached, represent the atoms needed to complete a julolydyl ring, $R^3$ represents H, or substituted or unsubstituted alkyl or aryl, $R^5$ and $R^6$ each independently represents H, or $R^5$ taken together with $R^1$, or $R^6$ taken together with $R^2$, represent the atoms necessary to complete a carbocyclic ring, and m is 0 or 1, the particles of said dispersion having a mean diameter of from about 0.01 to 10 μm.

5. A photographic element according to any of claims 1–4 wherein the dye is in the form of a solid particle dispersion.

6. A photographic element according to any of claims 1–4 wherein the dye is an arylidene dye having the formula:

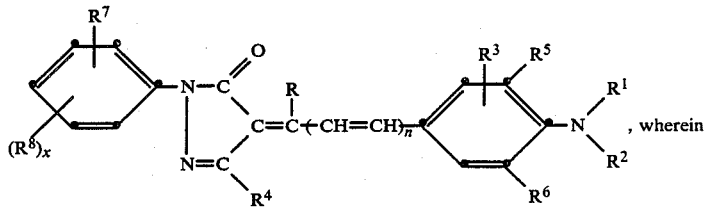

, wherein

R represents hydrogen, substituted or unsubstituted alkyl of 1 to 4 carbon atoms, or benzyl, $R^1$ and $R^2$ each independently represents substituted or unsubstituted alkyl or aryl, or taken together with $R^5$, $R^6$, N, and the carbon atoms to which they are attached, represent the atoms needed to complete a julolydyl ring, $R^3$ and $R^7$ each independently represents H, substituted or unsubstituted alkyl, aryl, alkoxy, hydrogen, or acetamido, $R^4$ represents substituted or unsubstituted alkyl, alkoxycarbonyl, aryl, acyl, or amido, $R^5$ and $R^6$ each independently represents H, or $R^5$ taken together with $R^1$, or $R^6$ taken together with $R^2$, represent the atoms necessary to complete a carbocyclic ring, $R^8$ is $CO_2H$ or $NHSO_2R^9$ wherein $R^9$ is substituted or unsubstituted alkyl or aryl, x is 1 or 2, and n is 0 or 1.

7. A photographic element according claim 6 wherein $R^1$ and $R^2$, each independently represents $$CH_3,\ C_2H_5,\ n{-}C_4H_9,\ \text{or}\ i{-}C_3H_1OC(=O)CCH_2,$$

$R^3$ represents H, $CH_3$, or OH, $R^4$ represents $CH_3$, $COOC_2H_5$, or COOH, $R^5$, $R^6$ and $R^7$ each represent H, or $R^5$, $R^6$, $R^1$ and $R^2$, together with the atoms to which they are attached, form a julolydyl ring.

8. A photographic element according to claim 1 or 4 wherein the layer containing said dye comprises a mixture of bis[1-(4-carboxyphenyl)-3-methyl-2-pyrazolin-5-one-(4)]pentamethine oxonol and a dye selected from the group consisting of:

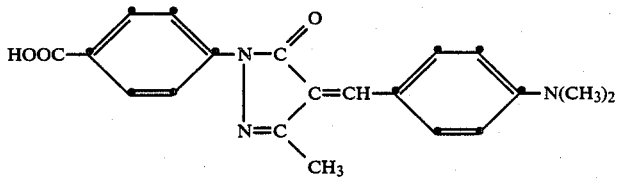

and

-continued
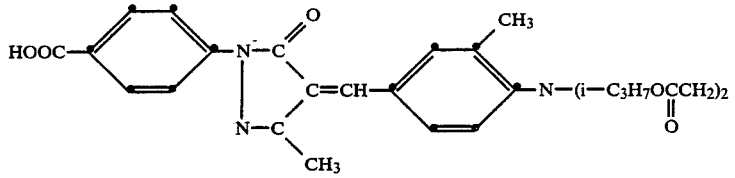
9. A photographic element according to claim 1 wherein the particles of said dispersion have a mean diameter of from about 0.01 to 1.0 μm.
10. A photographic element according to claim 4 wherein the particles of said dispersion have a mean diameter of from about 0.01 to 1.0 μm.
* * * * *

UNITED STATES PATENT AND TRADEMARK OFFICE

CERTIFICATE OF CORRECTION

PATENT NO. : 4,857,446

DATED : August 15, 1989

INVENTOR(S) : D. R. Diehl et al.

It is certified that error appears in the above-identified patent and that said Letters Patent is hereby corrected as shown below: Title Page:

Under "References Cited, U.S. PATENT DOCUMENTS", insert the following

| | | | |
|---|---|---|---|
| --3,445,231 | 5/1969 | Nishio et al. | 430/522 |
| 3,481,927 | 12/1969 | Heseltine et al. | 430/522 |
| 3,563,748 | 2/1971 | Depoorter et al. | 430/522 |
| 3,984,247 | 10/1976 | Nakamura et al. | 430/522--. |

Signed and Sealed this

Fifth Day of February, 1991

*Attest:*

*Attesting Officer*

HARRY F. MANBECK, JR.

*Commissioner of Patents and Trademarks*